US010436446B2

(12) United States Patent
Dery

(10) Patent No.: US 10,436,446 B2
(45) Date of Patent: Oct. 8, 2019

(54) SPRING LOADED AND SEALED CERAMIC MATRIX COMPOSITE COMBUSTOR LINER

(71) Applicant: GENERAL ELECTRIC COMPANY, Schenectady, NY (US)

(72) Inventor: Bryan Robert Dery, Mason, OH (US)

(73) Assignee: General Electric Company, Schenectady, NY (US)

( * ) Notice: Subject to any disclaimer, the term of this patent is extended or adjusted under 35 U.S.C. 154(b) by 583 days.

(21) Appl. No.: 14/917,736

(22) PCT Filed: Aug. 14, 2014

(86) PCT No.: PCT/US2014/050988

§ 371 (c)(1),
(2) Date: Mar. 9, 2016

(87) PCT Pub. No.: WO2015/038274

PCT Pub. Date: Mar. 19, 2015

(65) Prior Publication Data

US 2016/0215981 A1 Jul. 28, 2016

Related U.S. Application Data

(60) Provisional application No. 61/876,586, filed on Sep. 11, 2013.

(51) Int. Cl.
*F23R 3/00* (2006.01)
*F23R 3/60* (2006.01)

(52) U.S. Cl.
CPC ..... *F23R 3/007* (2013.01); *F23R 3/002* (2013.01); *F23R 3/60* (2013.01); *F05D 2240/35* (2013.01);
(Continued)

(58) Field of Classification Search
CPC ... F23R 3/002; F23R 3/007; F23R 3/42–3/46; F23R 3/50–3/58; F23R 3/60;
(Continued)

(56) References Cited

U.S. PATENT DOCUMENTS 3,922,851 A 12/1975 Irwin
4,567,730 A 2/1986 Scott
(Continued)

FOREIGN PATENT DOCUMENTS

CN 1854611 A 11/2006
CN 102434893 A 5/2012
(Continued)

OTHER PUBLICATIONS

European Search Report and Opinion issued in connection with related EP Application No. 12195693.2 dated Mar. 21, 2013.
(Continued)

*Primary Examiner* — Scott J Walthour
(74) *Attorney, Agent, or Firm* — General Electric; Kristi Davidson

(57) ABSTRACT

A combustor liner assembly of a gas turbine engine comprises a dome having a central axis aligned with an engine axis, the dome arranged at an inlet end of a combustor, a first spring disposed at a radially outward position of the dome, an outer liner retainer engaging a radially outer cowl and, the outer liner retainer having a sealing surface disposed in a radial plane for receiving an axial force, a ceramic matrix composite outer combustor liner having an outer liner sealing surface which is seated against the outer liner retainer, the first spring forcing the outer liner in an axial direction against the liner outer liner retainer, a ceramic matrix composite inner combustor liner having an inner liner sealing surface and engaging a radially inward surface of the dome, a second spring engaging the radially extending surface of the inner combustor liner, acting in an axial direction.

18 Claims, 5 Drawing Sheets

(52) U.S. Cl.
CPC ..... *F05D 2260/30* (2013.01); *F23R 2900/00017* (2013.01)

(58) Field of Classification Search
CPC .. F23R 2900/00005; F23R 2900/00012; F23R 2900/00017
See application file for complete search history.

(56) References Cited

U.S. PATENT DOCUMENTS

| | | | |
|---|---|---|---|
| 5,353,587 | A | 10/1994 | Halila |
| 5,687,572 | A | 11/1997 | Schrantz et al. |
| 6,397,603 | B1 | 6/2002 | Edmondson et al. |
| 6,655,148 | B2 | 12/2003 | Calvez et al. |
| 6,675,585 | B2 | 1/2004 | Calvez et al. |
| 6,732,532 | B2 | 5/2004 | Camy et al. |
| 6,895,761 | B2 | 5/2005 | Mitchell et al. |
| 6,904,757 | B2 | 6/2005 | Mitchell et al. |
| 7,117,983 | B2 | 10/2006 | Good et al. |
| 7,234,306 | B2 | 6/2007 | Aumont et al. |
| 7,249,462 | B2 | 7/2007 | Aumont et al. |
| 7,661,273 | B2 | 2/2010 | Commaret et al. |
| 7,665,307 | B2 | 2/2010 | Burd et al. |
| 8,387,504 | B2 | 3/2013 | Cairo et al. |
| 2002/0108378 | A1 | 8/2002 | Ariyoshi et al. |
| 2002/0184889 | A1 | 12/2002 | Calvez et al. |
| 2004/0036230 | A1 | 2/2004 | Matsuda et al. |
| 2004/0154303 | A1 | 8/2004 | Mitchell et al. |
| 2006/0032237 | A1 | 2/2006 | Aumont et al. |
| 2006/0242965 | A1 | 11/2006 | Shi et al. |
| 2007/0144178 | A1 | 6/2007 | Burd et al. |
| 2009/0193813 | A1 | 8/2009 | Garry et al. |
| 2009/0249790 | A1 | 10/2009 | Carrere et al. |
| 2009/0260364 | A1 | 10/2009 | Keller et al. |
| 2012/0047909 | A1 | 3/2012 | Ghanime |
| 2012/0279226 | A1 | 11/2012 | Chen et al. |
| 2012/0306166 | A1 | 12/2012 | Melton et al. |
| 2012/0328366 | A1 | 12/2012 | Jarmon et al. |
| 2013/0152591 | A1 | 6/2013 | Dery et al. |

FOREIGN PATENT DOCUMENTS

| | | | |
|---|---|---|---|
| CN | 102808949 | A | 12/2012 |
| CN | 102817641 | A | 12/2012 |
| DE | 2140401 | A1 | 3/1973 |
| EP | 1431665 | A2 | 6/2004 |
| EP | 1775517 | A2 | 4/2007 |
| EP | 1939529 | A1 | 7/2008 |
| EP | 2538141 | A2 | 12/2012 |
| EP | 2604926 | A1 | 6/2013 |
| FR | 2552860 | A1 | 4/1985 |
| GB | 1476414 | A | 6/1977 |
| JP | 52-87511 | A | 7/1977 |
| JP | 54-008264 | | 1/1979 |
| JP | 61-250129 | | 11/1986 |
| JP | 0295733 | A | 4/1990 |
| JP | 0694238 | A | 4/1994 |
| JP | 0719483 | A | 1/1995 |
| JP | 08-312961 | | 11/1996 |
| JP | 0953825 | A | 2/1997 |
| JP | 2002364850 | A | 12/2002 |
| JP | 2004076693 | A | 3/2004 |
| JP | 2006002773 | A | 1/2006 |
| JP | 2007170807 | A | 7/2007 |
| JP | 2009293915 | A | 12/2009 |

OTHER PUBLICATIONS

European Office Action issued in connection with Related EP Application No. 12195693.2 dated Feb. 14, 2014.
European Office Action issued in connection with Related EP Application No. 12195693.2 dated Nov. 21, 2014.
Chinese Office Action issued in connection with Related CN Application No. 201210540569.8 dated Jul. 27, 2015.
U.S. Non-Final Office Action issued in connection with Related U.S. Appl. No. 13/628,430 dated Jul. 29, 2015.
Chinese Office Action issued in connection with Related CN Application No. 201210540569.8 dated Feb. 2, 2016.
Chinese Office Action issued in connection with Related CN Application No. 201210540569.8 dated Aug. 24, 2016.
Japanese Office Action issued in connection with Related JP Application No. 2012-269898 dated Sep. 13, 2016.
Unofficial English Translation of Japanese Search Report issued in connection with Related JP Application No. 2012-269898 dated Nov. 30, 2016.
International Search Report and Written Opinion issued in connection with corresponding PCT Application No. PCT/US/2014/050988, dated Oct. 31, 2014.
Unofficial English Translation of Chinese Office Action issued in connection with corresponding CN Application No. 201480050289.6 dated Sep. 26, 2016.
Notification of Reasons for Refusal issued in connection with corresponding JP Application No. 2016-541977 dated Apr. 4, 2017.
European Office Action issued in connection with related EP Application No. 14758449.4 dated Apr. 12, 2017.

SPRING LOADED AND SEALED CERAMIC MATRIX COMPOSITE COMBUSTOR LINER

CROSS-REFERENCE TO RELATED APPLICATIONS

This application is a national stage application under 35 U.S.C. § 371(c) of prior filed, co-pending PCT application serial number PCT/US2014/050988, filed on Aug. 14, 2014, which claims priority to U.S. patent application Ser. No. 61/876,586, titled "Spring Loaded and Sealed Ceramic Matrix Composite Combustor Liner", filed Sep. 11, 2013. The above-listed applications are herein incorporated by reference.

BACKGROUND

Field of the Invention

Present embodiments relate generally to gas turbine engines. More particularly, but not by way of limitation, present embodiments relate to ceramic matrix composite combustor liners.

Description of the Related Art

A typical gas turbine engine generally possesses a forward end and an aft end with its several core or propulsion components positioned axially therebetween. An air inlet or intake is at a forward end of the engine. Moving toward the aft end of the engine, in order, the intake is followed in serial flow communication by a compressor, a combustion chamber and a turbine. It will be readily apparent from those skilled in the art that additional components may also be included in the gas turbine engine, such as, for example, low-pressure and high-pressure compressors, and high-pressure and low-pressure turbines. This, however, is not an exhaustive list. An engine also typically has an internal shaft axially disposed along a center longitudinal axis of the engine. The internal shaft is connected to both the turbine and the air compressor, such that the turbine provides a rotational input to the air compressor to drive the compressor blades.

In operation, air is pressurized in a compressor and mixed with fuel and ignited in a combustor for generating hot combustion gases which flow downstream through turbine stages. These turbine stages utilize blades to extract energy from the combustion gases. A high pressure turbine first receives the hot combustion gases from the combustor and includes a stator nozzle assembly directing the combustion gases downstream through a row of high pressure turbine rotor blades extending radially outwardly from a supporting rotor disk. In a multi-stage turbine, a second stage stator nozzle assembly is positioned downstream of the first rotor stage blades followed in turn by a row of second stage turbine rotor blades extending radially outwardly from a second supporting rotor disk. The turbine converts the combustion gas energy to mechanical energy and drive the shaft turning the high pressure compressor. One or more stages of a low pressure turbine may be mechanically coupled to a low pressure or booster compressor for driving the booster compressor and additionally an inlet fan.

In driving improvement of engine operating efficiency, it has been a desired goal to increase operating temperatures within the engine. However, one obstacle has been material temperature limitation which must be kept below critical levels. Otherwise, the material or component formed from the material may be damaged. One promising material has been ceramic matrix composite due to its lightweight, formability and ability to operate at extremely high temperatures associated with turbine engines. For example, in the area of combustor development, the combustor must be capable of meeting the design life requirements for use in the turbine engine operating temperature environment. The use of ceramic matrix composite (CMC) is desirable due to its temperature resistance characteristics. To enable combustor liners to operate effectively in such strenuous temperature conditions, it has been practiced to utilize composite and, in particular, ceramic matrix composite (CMC) materials for use in the shroud segments because they have higher temperature capability than metallic type parts. However, such ceramic matrix composites (CMC) have mechanical characteristics that must be considered during the design and application of the CMC combustor liners. CMC materials have a coefficient of thermal expansion which differs significantly from metal alloys used to form the combustor and to which the combustor liner is connected. Therefore, if a CMC component is restrained and cooled on one surface during operation, stress concentrations can develop leading to failure of the component. Additionally, vibration can lead to wear as well as problems with leakage about the combustor liner, all of which result in inefficient operation of the combustor.

As may be seen by the foregoing, it would be desirable to allow the use of ceramic matrix composites within the combustor so as to allow higher operating temperatures and more efficient gas turbine engine operation while compensating for the above operating condition and criteria.

The information included in this Background section of the specification, including any references cited herein and any description or discussion thereof, is included for technical reference purposes only and is not to be regarded subject matter by which the scope of the invention is to be bound.

SUMMARY

According to present embodiments, ceramic matrix composite (CMC) combustor liner is utilized by a spring loaded clamping or capturing assembly. The assembly provides an axial force on the combustor liner to retain the liner in position. Additionally, the use of the combustor liner spring loaded assembly provides for resistance to vibration and improved sealing of the combustion liner resulting in improved combustor operation.

According to some embodiments, a combustor liner assembly of a gas turbine engine, comprises a dome having a central axis aligned with an engine axis, the dome arranged at an input end of a combustor, a first spring disposed at a radially outward position of the dome, an outer liner retainer engaging a radially outer cowl and, the outer liner retainer having a surface disposed in a radial plane for receiving an axial force, a ceramic matrix composite outer combustor liner having an outer liner sealing surface which is seated against the outer liner retainer, the first spring forcing the outer liner in an axial direction against the outer liner retainer, a ceramic matrix composite inner combustor liner having an inner liner sealing surface and engaging a radially inward surface of the dome, a second spring engaging the radially extending surface of the inner combustor liner, the second spring acting in an axial direction to capture the inner combustor liner against the dome.

This Summary is provided to introduce a selection of concepts in a simplified form that are further described below in the Detailed Description. All of the above outlined features are to be understood as exemplary only and many more features and objectives of the embodiments may be gleaned from the disclosure herein. This Summary is not intended to identify key features or essential features of the claimed subject matter, nor is it intended to be used to limit the scope of the claimed subject matter. Therefore, no limiting interpretation of this summary is to be understood without further reading of the entire specification, claims, and drawings included herewith. A more extensive presentation of features, details, utilities, and advantages of the present embodiments is provided in the following written description, illustrated in the accompanying drawings, and defined in the appended claims.

BRIEF DESCRIPTION OF THE DRAWINGS

The above-mentioned and other features and advantages of this disclosure, and the manner of attaining them, will become more apparent and the spring loaded combustor liner will be better understood by reference to the following description of embodiments taken in conjunction with the accompanying drawings, wherein.

DETAILED DESCRIPTION

Figure 1:
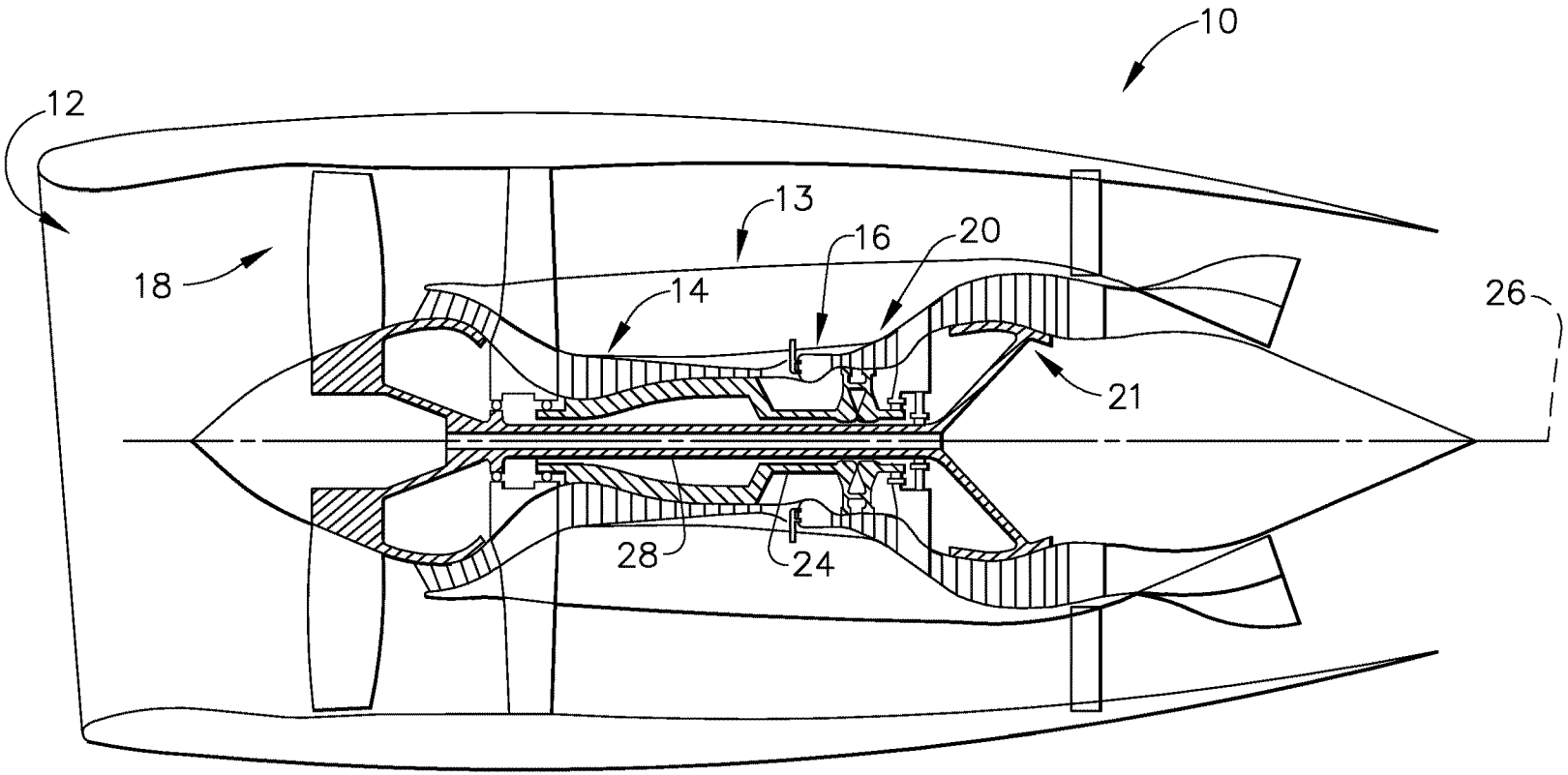
FIG. 1 is a side section view of a gas turbine engine.

Reference now will be made in detail to embodiments provided, one or more examples of which are illustrated in the drawings. Each example is provided by way of explanation, not limitation of the disclosed embodiments. In fact, it will be apparent to those skilled in the art that various modifications and variations can be made in the present embodiments without departing from the scope or spirit of the disclosure. For instance, features illustrated or described as part of one embodiment can be used with another embodiment to still yield further embodiments. Thus it is intended that the present embodiments cover such modifications and variations as come within the scope of the appended claims and their equivalents.

Referring to FIGS. 1-7 various embodiments of a spring loaded combustor liner wherein the liner is biased into position against at least one sealing surface. The combustor liner is formed of a ceramic matrix composite and the sealing surface is formed of a different material wherein the combustor liner and sealing surface having differing thermal rate of expansion. However, the spring biasing force maintains a sealed contact between the combustor liner and sealing surfaces despite the differences in growth rates. As well, the biased assembly maintains a proper seal for improved performance and resists problems associated with vibration.

As used herein, the terms "axial" or "axially" refer to a dimension along a longitudinal axis of an engine. The term "forward" used in conjunction with "axial" or "axially" refers to moving in a direction toward the engine inlet, or a component being relatively closer to the engine inlet as compared to another component. The term "aft" used in conjunction with "axial" or "axially" refers to moving in a direction toward the engine nozzle, or a component being relatively closer to the engine nozzle as compared to another component.

As used herein, the terms "radial" or "radially" refer to a dimension extending between a center longitudinal axis of the engine and an outer engine circumference.

Referring initially to FIG. 1, a schematic side section view of a gas turbine engine 10 is shown having an engine inlet end 12 wherein air enters the propulsor core 13 which is defined generally by a high pressure compressor 14, a combustor 16 and a multi-stage high pressure turbine 20. Collectively, the propulsor core 13 provides power during operation. Although the gas turbine engine 10 is shown in an aviation embodiment, such example should not be considered limiting as the gas turbine engine 10 may be used for aviation, power generation, industrial, marine or the like.

In operation, air enters through the engine inlet end 12 of the gas turbine engine 10 and moves through at least one stage of compression where the air pressure is increased and directed to the combustor 16. The compressed air is mixed with fuel and burned providing the hot combustion gas which exits the combustor 16 toward the high pressure turbine 20. At the high pressure turbine 20, energy is extracted from the hot combustion gas causing rotation of a rotor and turbine blades which in turn cause rotation of a high pressure shaft 24. The high pressure shaft 24 extends forward toward the front of the gas turbine engine 10 to continue rotation of the one or more high pressure compressor 14 stages. A low pressure turbine 21 may also be utilized to extract further energy and power from additional low pressure compressor stages. A fan 18 is connected by the low pressure shaft 28 to the low pressure turbine 21 to create thrust for the gas turbine engine 10. This may be direct connection or indirect through a gearbox or other transmission. The low pressure air may be used to aid in cooling components of the gas turbine engine 10 as well.

The gas turbine engine 10 is axisymmetrical about engine axis 26 so that various engine components rotate thereabout. An axisymmetrical high pressure shaft 24 extends through the turbine engine forward end into an aft end and is journaled by bearings on the shaft structure. The high pressure shaft 24 rotates about an engine axis 26 of the gas turbine engine 10. The high pressure shaft 24 may be hollow to allow rotation of a low pressure shaft 28 therein and independent of the high pressure shaft rotation. The low pressure shaft 28 also may rotate about the engine axis 26 of the engine. During operation, the shafts 24, 28 rotate along with other structures connected to the shafts such as the rotor assemblies of the turbine 20, 21 in order to create power for various types of operations including, but not limited to, power and industrial, marine or aviation areas of use.

Figure 2:
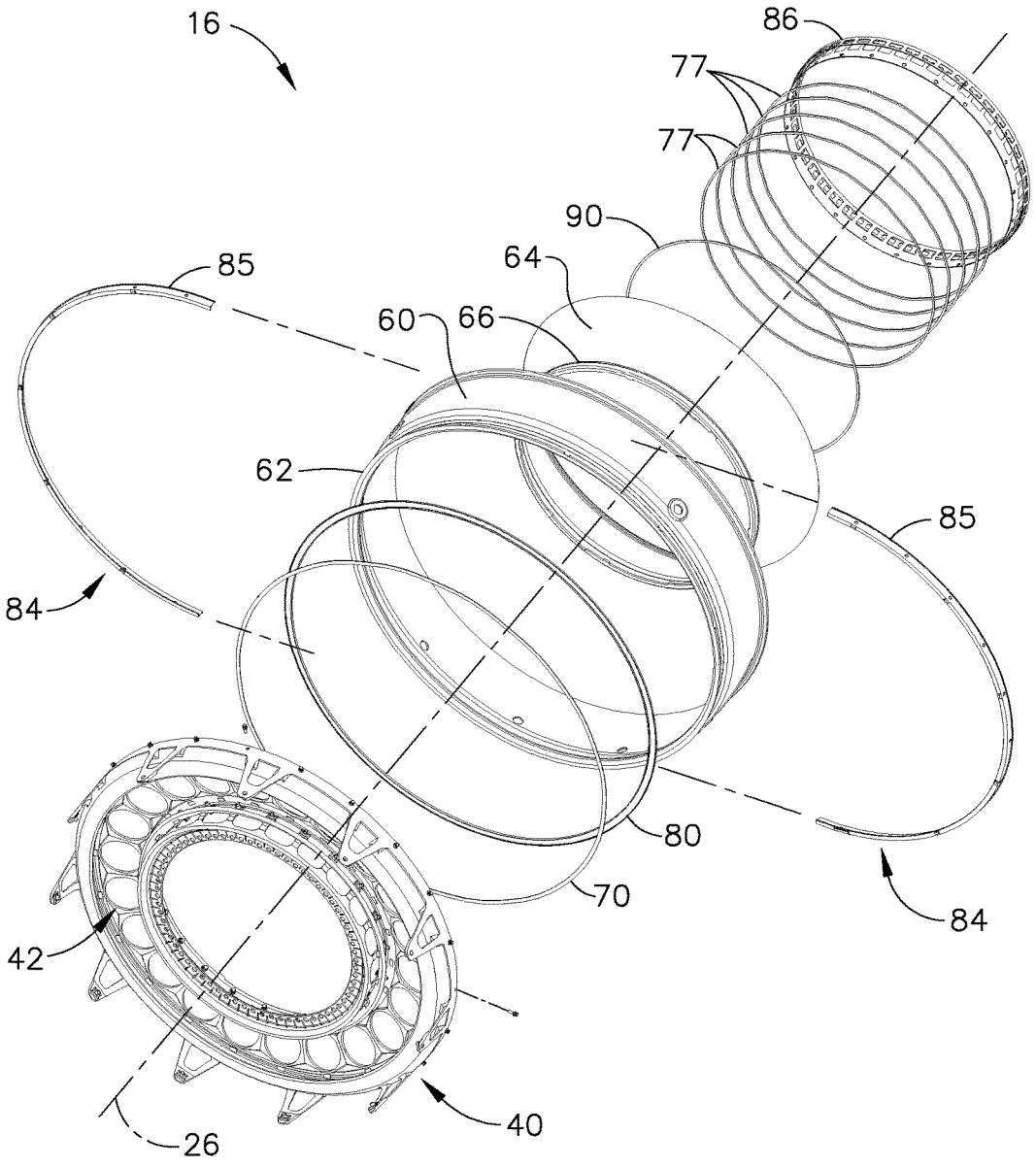
FIG. 2 is an exploded isometric assembly of a combustor.

Referring now to FIG. 2, an exploded isometric assembly of the combustor 16 is depicted. In the exploded assembly, an outer cowl 40 is shown at the lower left area of the figure. The outer cowl 40 defines an inlet and a pathway for air to enter a combustor dome 42. A number of the outer cowls 40 may be spaced about the engine axis 26. The outer cowl 40 is generally annular in shape and may be formed of various materials including, but not limited to, metal alloys. Within the outer cowl 40 is the combustor dome 42 and combustion air passes through the combustor dome 42. Adjacent to the outer cowl 40 and combustor dome 42, the spring 70 pushes from the combustor dome 42 and against a spring plate 80. The spring plate 80 acts against an outer liner flange 62, also referred to as an outer liner sealing surface, of the outer combustor liner 60 to capture the outer liner flange 62 between the spring plate 80 and an outer liner retainer 84. The spring 70 acts in an axially aft direction from the combustor dome 42. The axial force may be forward or aft.

Figure 3:
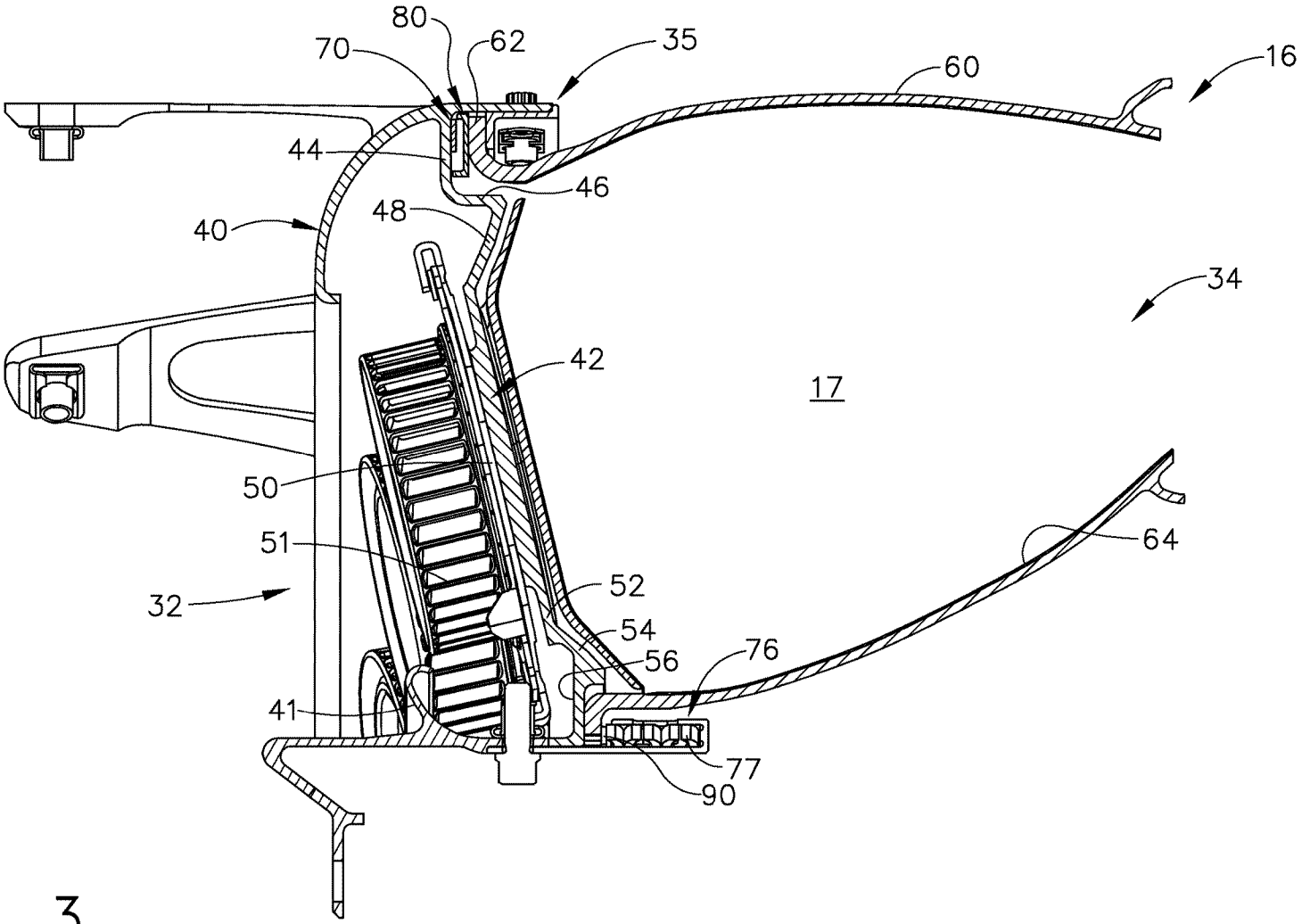
FIG. 3 is a side section view of an assembly combustor.

Radially inward of outer combustor liner 60, is the inner combustor liner 64. The liners 60, 64 provide some temperature protection from the combustion process and may allow for introduction of cooling air into the combustion chamber 17 (FIG. 3). The inner combustor liner 64 has an inner liner flange 66 against which the spring 76 (FIG. 3) acts to retain the inner combustor liner 64 in position. As with the outer liner 60, the inner liner flange 66 defines an inner liner sealing surface. The spring 76 may be formed of a plurality of springs 77 according to some embodiments. The springs 77 act against inner liner retainer 86 to push the inner combustor liner 64 in the forward direction. This exploded assembly will be further described in the following section views.

Referring now to FIG. 3, a side section of a gas turbine engine combustor 16 is depicted. The combustor 16 has an inlet end 32 and an outlet end 34 which extend annularly about the engine axis 26. Inlet end 32 is arranged forward in an axial direction of the outlet end 34. It will be seen that combustor 16 further includes a combustion chamber 17 defined by the outer combustor liner 60, the inner combustor liner 64 and the combustor dome 42. The combustor dome 42 is shown as being single annular in design so that a single circumferential row of fuel/air mixers 51 are provided within openings formed in such combustor dome 42, although a multiple-segment annular dome may alternatively be utilized. A fuel nozzle (not shown) provides fuel to fuel/air mixers 51 in accordance with desired performance of combustor 16 at various engine operating states. It will also be noted that the cowl outer 40 may include an outer cowl and an inner cowl 41 are located upstream of combustion chamber 17 so as to direct air flow into fuel/air mixers 51. A diffuser (not shown) receives the air flow from the compressor(s) and provides it to combustor 16.

It will be appreciated that outer and inner liners 60, 64 may be formed of a Ceramic Matrix Composite (CMC), which is a non-metallic material having high temperature capability and low ductility. Generally, CMC materials include a ceramic fiber, for example a silicon carbide (SiC), forms of which are coated with a compliant material such as boron nitride (BN). The fibers are coated in a ceramic type matrix, one form of which is silicon carbide (SiC). Typically, the liners 60, 64 are constructed of low-ductility, high-temperature-capable materials. CMC materials generally have room temperature tensile ductility of less than or equal to about 1% which is used herein to define a low tensile ductility material. More specifically, CMC materials have a room temperature tensile ductility in the range of about 0.4% to about 0.7%. Exemplary composite materials utilized for such liners include silicon carbide, silicon, silica or alumina matrix materials and combinations thereof. Typically, ceramic fibers are embedded within the matrix such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). CMC materials typically have coefficients of thermal expansion in the range of about $1.3\times10^{-6}$ in/in/degree F. to about $3.5\times10^{-6}$ in/in/degree F. in a temperature of approximately 1000-1200 degrees F.

Formation processes generally entail the fabrication of CMCs using multiple prepreg layers, each in the form of a "tape" comprising the desired ceramic fiber reinforcement material, one or more precursors of the CMC matrix material, and organic resin binders. According to conventional practice, prepreg tapes can be formed by impregnating the reinforcement material with a slurry that contains the ceramic precursor(s) and binders. Materials for the precursor will depend on the particular composition desired for the ceramic matrix of the CMC component, for example, SiC powder and/or one or more carbon-containing materials if the desired matrix material is SiC. Notable carbon-containing materials include carbon black, phenolic resins, and furanic resins, including furfuryl alcohol ($C_4H_3OCH_2OH$). Other typical slurry ingredients include organic binders (for example, polyvinyl butyral (PVB)) that promote the pliability of prepreg tapes, and solvents for the binders (for example, toluene and/or methyl isobutyl ketone (MIBK)) that promote the fluidity of the slurry to enable impregnation of the fiber reinforcement material. The slurry may further contain one or more particulate fillers intended to be present in the ceramic matrix of the CMC component, for example, silicon and/or SiC powders in the case of a Si—SiC matrix.

After allowing the slurry to partially dry and, if appropriate, partially curing the binders (B-staging), the resulting prepreg tape is laid-up with other tapes, and then debulked and, if appropriate, cured while subjected to elevated pressures and temperatures to produce a preform. The preform is then heated (fired) in a vacuum or inert atmosphere to decompose the binders, remove the solvents, and convert the precursor to the desired ceramic matrix material. Due to decomposition of the binders, the result is a porous CMC body that may undergo melt infiltration (MI) to fill the porosity and yield the CMC component. Specific processing techniques and parameters for the above process will depend on the particular composition of the materials.

CMC materials have a characteristic wherein the material's tensile strength in the direction parallel to the length of the fibers (the "fiber direction") is stronger than the tensile strength in the direction perpendicular. This perpendicular direction may include matrix, interlaminar, secondary or tertiary fiber directions. Various physical properties may also differ between the fiber and the matrix directions. The fibers of the outer liner flange 62 and the inner liner flange 66 may extend in an engine radial direction for improved strength, according to some embodiments.

By contrast, combustor dome 42, outer cowl 40, and inner cowl 41 are typically made of a metal, such as, for example, a nickel-based superalloy (having a coefficient of thermal expansion of about $8.3\text{-}8.5\times10^{-6}$ in/in/degree F. in a temperature of approximately 1000-1200 degrees F.) or cobalt-based superalloy (having a coefficient of thermal expansion of about $7.8\text{-}8.1\times10^{-6}$ in/in/degree F. in a temperature of approximately 1000-1200 degree F.). Convective cooling air may be provided to the surfaces of outer and inner liners 60, 64, respectively, and air for film cooling may be provided to the inner and outer surfaces of such liners. Thus, liners 60 and 64 are better able to handle the extreme temperature environment presented in combustion chamber 17 due to the materials utilized therefor, but attaching them to the different materials utilized for combustor dome 42 and cowls 40, 41 presents a separate challenge. Among other limitations, the metallic components cannot be welded to the CMC material of outer and inner liners 60 and 64.

A mounting assembly 35 is provided for a forward end of a radially outer combustor liner 60, an aft portion of radially outer cowl 40, and a radially outer portion of combustor dome 42 so as to accommodate varying thermal growth experienced by such components. It will be appreciated that the mounting arrangement shown in FIG. 3 is prior to any thermal growth experienced by outer combustor liner 60, outer cowl 40 and outer portion of combustor dome 42. During operation however, outer combustor liner 60, outer cowl 40 and combustor dome 42 outer portion each experienced thermal growth, in the radial direction. Accordingly, the aft portion of the outer cowl 40 and combustor dome 42 outer portion slide or move in a radial direction with respect to longitudinal engine axis 26 toward outer combustor liner 60. According to instant embodiments, the outer combustor liner 60 is allowed to move with such growth without loosening and allowing vibration and further while maintaining a sealed condition and inhibiting leakage.

The combustor 16 includes the outer cowl 40 and the combustor dome 42 wherein the outer cowl 40 also extends annularly and is joined with the combustor dome 42 along a radially inner surface of the outer cowl 40. The combustor dome 42 depends downwardly from the outer cowl 40 in a radial direction and is formed of various segments so as to position the combustor dome 42 generally between an outer combustor liner 60 and an inner combustor liner 64. The combustor dome 42 includes at least a first segment 44 depending from the outer cowl 40. A second segment 46 depends from the first segment 44 and turns axially in a forward direction before a third segment 48 turns diagonally downward at an angle and joins a mixer plate portion of the dome beneath the third segment 48 of the mixer plate 50 which extends down to a lower portion of the dome 42 having a plurality of segments 52, 54, 56. The first, second and third segments 44, 46, 48 are formed as a unitary structure but may alternative be formed separately and later fastened, welded, brazed or otherwise connected.

Opposite the outer first segment 44 is the outer combustor liner 60 which generally extends in an axial direction and includes an outer liner flange 62 extending radially upward. The outer liner flange 62 defines an outer liner sealing surface which mates with the first segment 44. The outer liner flange 62 and the outer first segment 44 of the combustor dome 42 have parallel surfaces wherein a spring 70 may be located therebetween to act in an axial direction against the combustor dome 42 and toward the outer combustor liner 60.

Figure 4:
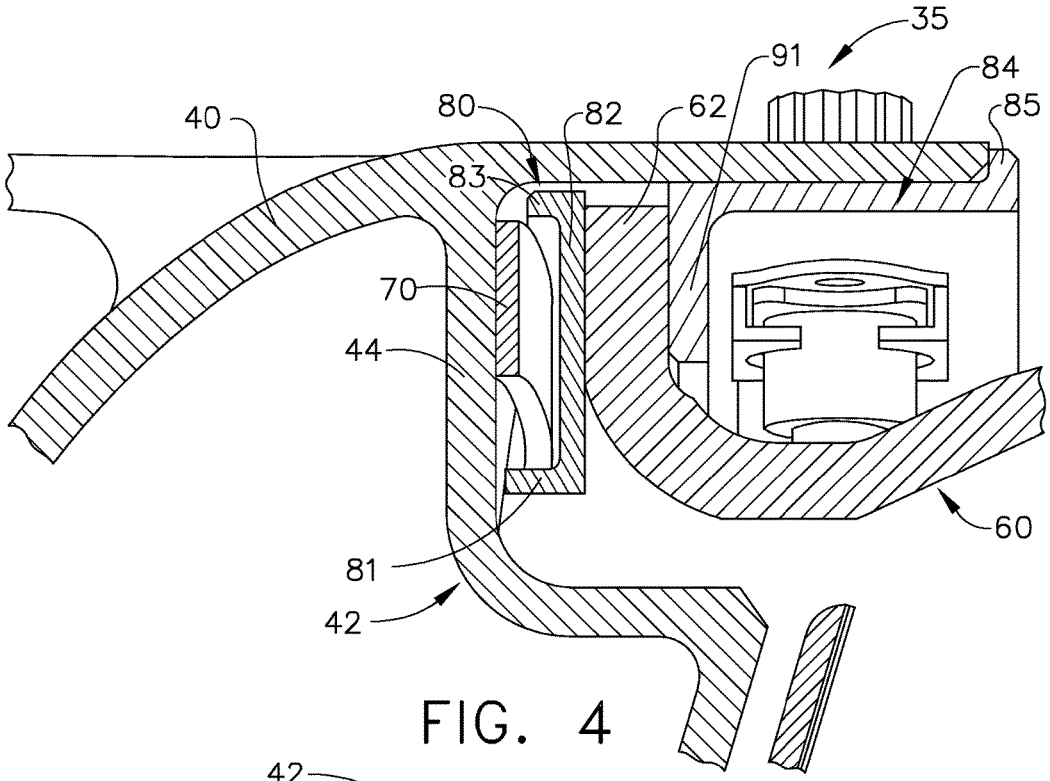
FIG. 4 is a section view of an outer liner assembly.

Referring additionally now to FIG. 4, a detailed section view of the combustor dome 42 and outer combustor liner 60 is depicted. At the first segment 44, a spring 70 is positioned to urge or bias in an axial direction pushing from the outer dome first segment 44 in an axial direction. The spring 70 may take various forms and for example may be a wavy spring having a plurality of peaks and valleys which extend generally forward and aft in the engine axial direction. The spring 70 may extend annularly about the engine axis 26 of the engine as a single segment or in multiple segments providing a force from against the first segment 44 of the combustor dome 42. According to some embodiments, the spring 70 may act directly against the outer liner flange 62. However, as depicted in the section view, the spring 70 may also act against a spring plate 80. The spring plate 80 functions as a wear plate inhibiting excessive wear on the outer liner flange 62. The spring plate 80 may be formed of a planar body extending annularly or may be formed of two or more segments extending annularly about the engine axis 26. As shown in the instant embodiment, the spring plate 80 is constructed as a spring housing which is generally U-shaped including first, second and third sides 81, 82, 83. However, the spring housing but may be formed of various shapes to aid in retaining the spring 70 in position.

The spring plate 80 urges the liner 60 axially against an outer liner retainer 84. The outer liner retainer 84 is disposed along a radially inner surface of the outer cowl 40. By capturing the outer liner flange 62 against the outer liner retainer 84, a seal is formed between the liner 60 and outer liner retainer 84. The seal is annular and generally extends about the engine axis 26. Opposite the outer combustor liner 60, the outer liner retainer 84 is generally L-shaped but, for example, may include an outer liner retainer lip 85 to properly position the outer liner retainer 84 at the end of the outer cowl 40. However, various shapes may be utilized as long as a surface or other sealing structure is provided to cause a seal against or with the liner 60. The outer liner retainer 84 may be formed of an annular unitary structure or may be formed of two or more segments which extend annularly about the engine axis 26 of the gas turbine engine 10.

The instant configuration allows the spring 70 to act against the dome 42 forcing the spring plate 80 and the outer combustor liner 60 against the outer liner retainer 84 so that the assembly is sandwiched in position and the outer combustor liner 60 cannot move. By capturing the outer combustor liner 60 in such a manner, the spring 70 provides an axial load sufficient to seat the outer combustor liner 60 against the metallic outer liner retainer 84. As the outer cowl 40 and combustor dome 42 expand, the mounting assembly 35 retains the outer combustor liner 60 engaged with the dome and the outer liner retainer 84, to create and maintain the sealed condition in all engine operating conditions. The arrangement also inhibits vibration in the axial direction which may cause premature impact wear, transient leakage or unsteady operation of the combustor. By utilizing the spring 70, the outer liner flange 62 is seated against the outer liner retainer 84 and vibration between the outer combustor liner 60 and the outer liner retainer 84 is eliminated. Further, wear, leakage and unsteady combustor operation problems are eliminated.

Figure 5:
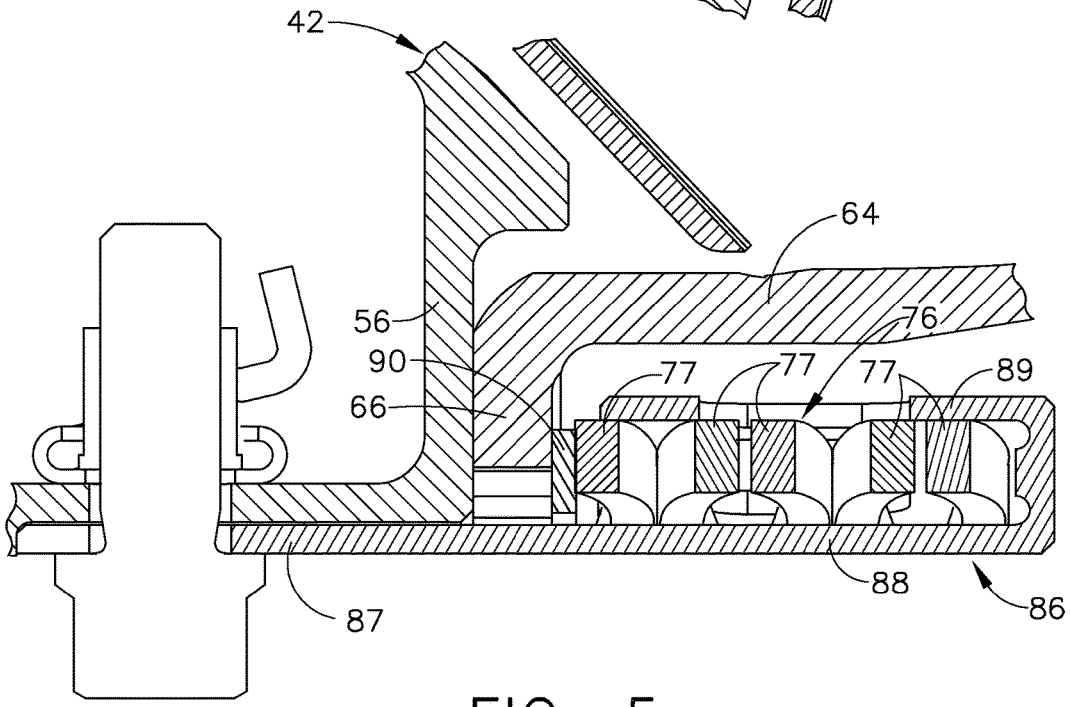
FIG. 5 is a section view of an inner liner assembly.

Referring again to FIG. 2, FIG. 3 and additionally FIG. 5 wherein a detailed section view of an inner liner assembly of the combustor 16 is depicted. At the radially inward side of the combustor 16 is the inner combustor liner 64 which includes an inner liner flange 66 that turns radially inward (downward) and is seated against the third inner segment 56 of the combustor dome 42. On this lower side of the combustor 16, a mixer plate 50 is disposed with a first inner segment 52 depending therefrom, a second inner segment 54 which extends at an angle to the first inner segment 52, and a third inner segment 56 which extends generally radially inward. The inner combustor liner 64 and inner liner flange 66 are seated against this third inner segment 56 to allow the inner liner flange 66 to be captured between an inner liner retainer 86 and the dome third inner segment 56. This provides seal between the inner liner retainer 86 and the combustor dome 42. The inner liner flange 66 may be planar and engage a spring 76 or wear plate 90. As previously described with respect to the outer combustor liner 60, this also eliminates problems associated with material thermal growth mismatches between the inner liner retainer 86, combustor dome 42 and inner combustor liner 64. The inner assembly includes a spring 76 to urge engagement between the inner liner retainer 86 and the inner combustor liner 64. Additionally, the spring 76 and wear plate 90 combination provide an axial force in an aft to forward direction, opposite the assembly outer combustor liner 60, which also eliminates impact wear, transient leakage and unsteady operating condition of the combustor. Ultimately, these assemblies further reduce emissions and provide greater durability which results in longer engine time on the wing and lower overhaul costs associated with the engine operation.

The inner liner retainer 86 may have various forms and according to the instant embodiment of the lower flange 87 and a horizontal body 88 extending to an inner liner retainer lip 89 which is L-shaped to retain the spring 76. The spring 76 is longer in axial dimension than spring 70 according to instant embodiments and may be formed of one or more springs 77 which have multiple peaks and valleys that extend annularly about the center line engine axis 26 within the inner liner retainer 86. As a result of the use of multiple of these springs 77, with the spring 76 acting against the rigid inner liner retainer 86, an axial force is placed on the wear plate 90 and against the inner liner flange 66. As a result, the inner combustor liner 64 is inhibited from movement and further inhibits leakage while the assembly resists wear of the liner 64 as well.

According to either of these embodiments, the springs 70, 76 act in an axial direction to capture the CMC liners 60, 64 in position between the combustor dome 42 and liner retainers 84, 86. Both of these embodiments inhibit premature impact wear associated with vibration of the engine on the CMC liners 60, 64. The loading must be sufficient to seat the liners 60, 64 against the retainers 84, 86 or the dome segments 44, 56.

Figure 6:
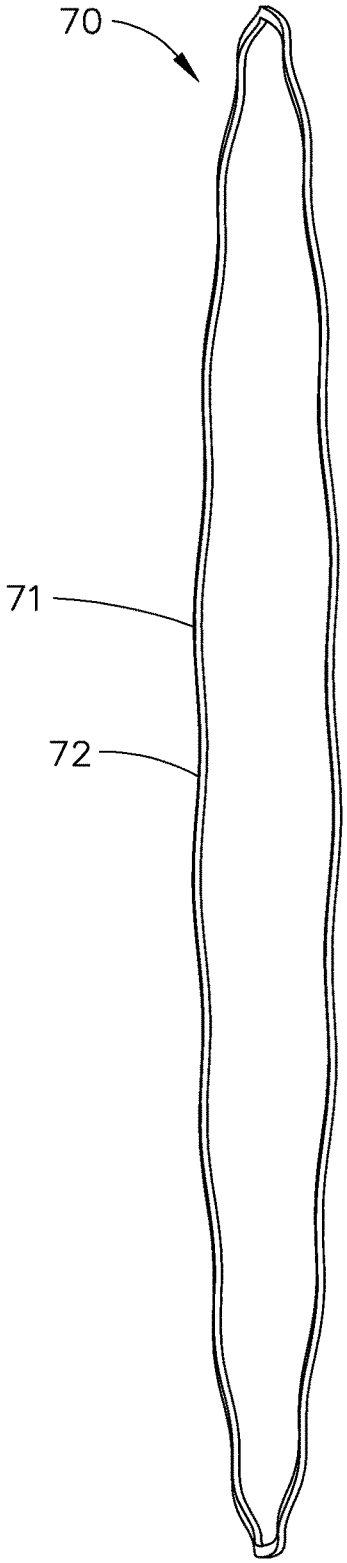
FIG. 6 is an isometric view of a first spring of the outer liner assembly; and, FIG. 7 is an isometric view of a second spring of the inner liner assembly.

Referring to FIG. 6, an isometric view of spring 70 is shown. The spring 70 is in the form of an annular wavy spring. The spring has multiple peaks 71 and valleys 72 that extend in the forward and aft directions. The spring 70 may be formed of a creep resistant alloy such as, for non-limiting example, WASPALOY, RENE 41, or GTD222. The spring biases the outer combustor liner 60 against the sealing surface of the outer liner retainer 84.

Various alternate designs may be utilized. For example, the spring 70 may be replaced with segments which form the annular shape. Alternatively, the spring maybe formed of two or more structures which do not form a full annular shape but which provide the axial spring force. For example a plurality of v-shaped or u-shaped structures may be formed on the combustor dome 42 to force the spring plate against the outer liner flange 62. Additionally, for example, a plurality of coil springs may be arranged about the combustor dome 42 in order to provide the axial force.

Figure 7:
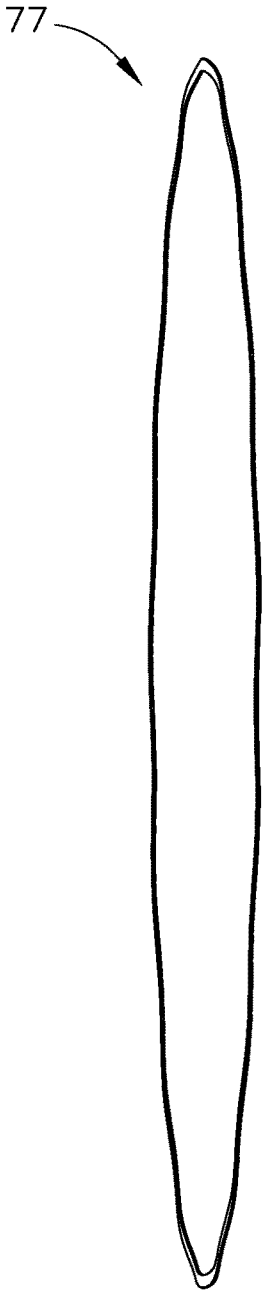

Referring to FIG. 7, an isometric view of the spring 77 is shown. As previously described, spring 77 is also a wavy spring which provides an axial force on the inner combustor liner 64. The instant embodiment may utilize one or more springs 77 to provide the desired spring force. As with the embodiment of FIG. 6, the spring 77 includes a plurality of peaks and valleys which extend in the axial direction in order to provide a spring force against the liner 64.

As described with respect to FIG. 6, various alternate embodiments may be utilized to provide the axial force on the liner 64. For example, segments of wavy spring may form the annular shape, rather than a single structure. As a further alternative, the spring force may be provided by a plurality of U-shaped or V-shaped structures connected to the inner liner retainer 86 and engaging the inner combustor liner 64, either directly or indirectly.

In a further alternative, the springs 70, 76 may be arranged to direct the axial force in directions opposite those shown. Additionally, it should be understood that while the axial forces on the liners 60, 64 are described and directed to act in opposite directions, the forces may alternatively be arranged in the same directions.

According to instant embodiments, the clamped liner assembly overcomes know prior art problems wherein material differences are exacerbated by thermal expansion within a high temperature operating environment. The CMC combustor liner is clamped by spring force against the metallic structure of the combustor so that when thermal growth of different rates does not allow leakage between the liner and the remaining structure of the combustor. The spring force acts in an axial direction to maintain seating of the liner inhibit problems associated with different thermal growth rates, vibration and improper sealing.

The foregoing description of structures and methods has been presented for purposes of illustration. It is not intended to be exhaustive or to limit the structures and methods to the precise forms and/or steps disclosed, and obviously many modifications and variations are possible in light of the above teaching. Features described herein may be combined in any combination. Steps of a method described herein may be performed in any sequence that is physically possible. It is understood that while certain forms of composite structures have been illustrated and described, it is not limited thereto and instead will only be limited by the claims, appended hereto.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Examples are used to disclose the embodiments, including the best mode, and also to enable any person skilled in the art to practice the apparatus and/or method, including making and using any devices or systems and performing any incorporated methods. These examples are not intended to be exhaustive or to limit the disclosure to the precise steps and/or forms disclosed, and many modifications and variations are possible in light of the above teaching. Features described herein may be combined in any combination. Steps of a method described herein may be performed in any sequence that is physically possible.

All definitions, as defined and used herein, should be understood to control over dictionary definitions, definitions in documents incorporated by reference, and/or ordinary meanings of the defined terms. The indefinite articles "a"

and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

What is claimed is:

1. A combustor in a gas turbine engine, comprising:

an outer cowl having a dome extending radially inwardly from an inner surface of the outer cowl, the dome having a central axis aligned with an engine axis, said dome arranged at an inlet end of the combustor;

a first spring disposed at a radially outward position of said dome;

an outer liner retainer engaging the outer cowl, said outer liner retainer having a sealing surface disposed in a radial plane for receiving an axial force from said first spring;

a ceramic matrix composite (CMC) outer combustor liner having an outer liner flange positioned between the first spring and the outer liner retainer, the outer liner flange being seated against the sealing surface of said outer liner retainer, said first spring forcing said CMC outer combustor liner in an axial direction against said outer liner retainer;

a ceramic matrix composite (CMC) inner combustor liner having an inner liner flange and engaging a radially inward surface of said dome;

a second spring engaging said inner liner flange of said CMC inner combustor liner, said second spring acting in an axial direction to force said CMC inner combustor liner against said dome.

2. The combustor of claim 1, wherein said first spring is a wave spring.

3. The combustor of claim 2, further comprising a first spring plate disposed between said first spring and said outer liner flange.

4. The combustor of claim 3, wherein said first spring plate forms a spring housing.

5. The combustor of claim 4, said first spring being housed within said spring housing and acting against said dome.

6. The combustor of claim 1, further comprising an inner liner retainer disposed at a radially inward position of said dome.

7. The combustor of claim 6, said second spring engaging both said inner liner retainer and a wear plate.

8. The combustor of claim 7, said wear plate engaging said inner liner flange of said CMC inner combustor liner.

9. The combustor of claim 8, wherein said second spring is a wave spring.

10. The combustor of claim 1, wherein said outer liner flange extends radially.

11. The combustor of claim 1, wherein said inner liner flange extends radially.

12. The combustor of claim 6, wherein said dome, said CMC inner combustor liner and said inner liner retainer engage each other at a radially inner position of a combustor of said gas turbine engine.

13. The combustor of claim 1, wherein said CMC outer combustor liner is forced axially in a forward direction.

14. The combustor of claim 13, wherein said CMC inner combustor liner is forced axially in an aft direction.

15. The combustor of claim 3, wherein said outer cowl and said dome define an intersection where said first spring and said first spring plate are disposed.

16. The combustor of claim 3, wherein said outer liner flange and said first spring plate are each planar and parallel with respect to each other.

17. The combustor of claim 16, wherein fibers of said outer liner flange extend in a substantially radial direction.

18. The combustor of claim 17, wherein said outer liner sealing surface extends in a substantially circumferential direction.

* * * * *